US006468110B2

(12) United States Patent
Fujino et al.

(10) Patent No.: US 6,468,110 B2
(45) Date of Patent: Oct. 22, 2002

(54) SHIELDED-CABLE CONNECTOR IMPROVED IN TRANSMISSION CHARACTERISTICS

(75) Inventors: Kazuhiro Fujino, Chofu; Koji Hayashi, Tachikawa; Nobukazu Kato, Fussa; Tomohiko Tamada, Hamura, all of (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 09/833,952

(22) Filed: Apr. 12, 2001

(65) Prior Publication Data

US 2001/0031579 A1 Oct. 18, 2001

(30) Foreign Application Priority Data

Apr. 17, 2000 (JP) ..... 2000-114639

(51) Int. Cl.[7] ..... H01R 9/03; H01R 13/40; H01R 9/05; H01R 13/02; H01R 9/24

(52) U.S. Cl. ..... 439/610; 439/733.1; 439/579; 439/884

(58) Field of Search ..... 439/608, 610, 439/733.1, 579, 884, 874, 98

(56) References Cited

U.S. PATENT DOCUMENTS 5,364,292 A * 11/1994 Bethurum ..... 439/610
5,725,387 A * 3/1998 O'Sullivan et al. ..... 439/98
5,785,555 A * 7/1998 O'Sullivan et al. ..... 439/610
5,823,825 A * 10/1998 Murphy ..... 439/610
5,961,348 A * 10/1999 Murphy ..... 439/579
6,056,597 A * 5/2000 Shepherd et al. ..... 439/579
6,129,565 A * 10/2000 Lai ..... 439/101
6,210,230 B1 * 4/2001 Lai ..... 439/610

FOREIGN PATENT DOCUMENTS

JP 10-32051 2/1998 ..... H01R/13/652

* cited by examiner

*Primary Examiner*—P. Austin Bradley
*Assistant Examiner*—Edwin A. León
(74) *Attorney, Agent, or Firm*—Michael Best & Friedrich

(57) ABSTRACT

In a shielded-cable connector (10) for use in connecting a mating connector with a shielded cable (13), a metal plate (22) is used to face a side surface of the shielded cable. A positioning portion (27) is engaged with an insulating inner sheath (15) of the shielded cable. Thus, a predetermined positional relationship is given between the metal plate and a core wire (14) of the shielded cable. The core wire is connected to a contact (11) held by an insulator housing (21). The contact has a contacting portion (18) to be connected to the mating connector and a cable connecting portion 19 to be connected to the core wire.

12 Claims, 3 Drawing Sheets

SHIELDED-CABLE CONNECTOR IMPROVED IN TRANSMISSION CHARACTERISTICS

BACKGROUND OF THE INVENTION

This invention relates to a shielded-cable connector to be connected to a shielded cable known in the art.

A typical shielded cable comprises a center conductor or a core wire having conductivity, a tubular insulating inner sheath surrounding the core wire, a conductive shield wire surrounding the insulating inner sheath, and an insulating member surrounding the shield wire. The shielded cable is connected by the use of a shielded-cable connector.

One example of the shielded-cable connector is disclosed in Japanese Unexamined Patent Publication (JP-A) No. H10-32051. The shielded-cable connector comprises a ground plate for holding the shield wire of the cable, a contact to be connected to the core wire of the cable, and an insulating housing holding the ground plate and the contact.

In the above-mentioned shielded-cable connector, the ground plate holds the shield wire of the cable but the positional relationship between the core wire of the cable and the ground plate is not fixed. This may possibly result in deterioration of transmission characteristics within the connector.

SUMMARY OF THE INVENTION

It is therefore an object of the present invention to provide a shielded-cable connector which is capable of preventing deterioration of transmission characteristics.

Other objects of the present invention will become clear as the description proceeds.

According to an aspect of the present invention, there is provided a shielded-cable connector for use in connecting a mating connector with a shielded cable which comprises a first conductive wire, a first insulating member surrounding said first conductive wire, a second insulating member surrounding said first insulating member, and a second conductive wire extending between said first and said second insulating member, said shielded-cable connector comprising an insulator housing, a conductive contact held by said insulator housing, said conductive contact comprising a contacting portion for coming in contact with said mating connector and a cable connecting portion to be connected to said first conductive wire, and a metal member held by said insulator, said metal member comprising a plate portion for facing said first insulating member in a radial direction of said shielded cable and a positioning portion connected to said plate portion for engaging with said first insulating member to provide a predetermined positional relationship between said first conductive wire and said plate portion.

According to another aspect of the present invention, there is provided a shielded-cable connector for use in connecting a mating connector with a shielded cable which comprises a first conductive wire, a first insulating member surrounding said first conductive wire, a second insulating member surrounding said first insulating member, and a second conductive wire extending between said first and said second insulating member, said shielded-cable connector comprising an insulator housing, a conductive contact held by said insulator housing, said conductive contact comprising a contacting portion for coming in contact with said mating connector and a cable connecting portion to be connected to said first conductive wire, and a metal member held by said insulator, said metal member comprising a plate portion for facing said first insulating member in a radial direction of said shielded cable and a positioning portion connected to said plate portion for engaging with said first insulating member to provide a predetermined positional relationship between said first conductive wire and said plate portion, and a hood covering said insulator housing and said metal member.

According to still another aspect of the present invention, there is provided a shielded-cable connector for use in connecting a mating connector with a plurality of shielded cables each of which comprises a first conductive wire, a first insulating member surrounding said first conductive wire, a second insulating member surrounding said first insulating member, and a second conductive wire extending between said first and said second insulating member, said shielded-cable connector comprising an insulator housing a plurality of conductive contacts held by said insulator housing, each of said conductive contacts comprising a contacting portion for coming in contact with said mating connector and a cable connecting portion to be connected to said first conductive wire, a plurality of metal members held by said insulator, each of said metal member comprising a plate portion for facing said first insulating member in a radial direction of each of said shielded cables and a positioning portion connected to said plate portion for engaging with said first insulating member to provide a predetermined positional relationship between said first conductive wire and said plate portion, and a locator housing coupled to said insulator housing and holding said metal members to have a predetermined interval between adjacent ones of said metal members.

DESCRIPTION OF THE PREFERRED EMBODIMENT

Figure 1:
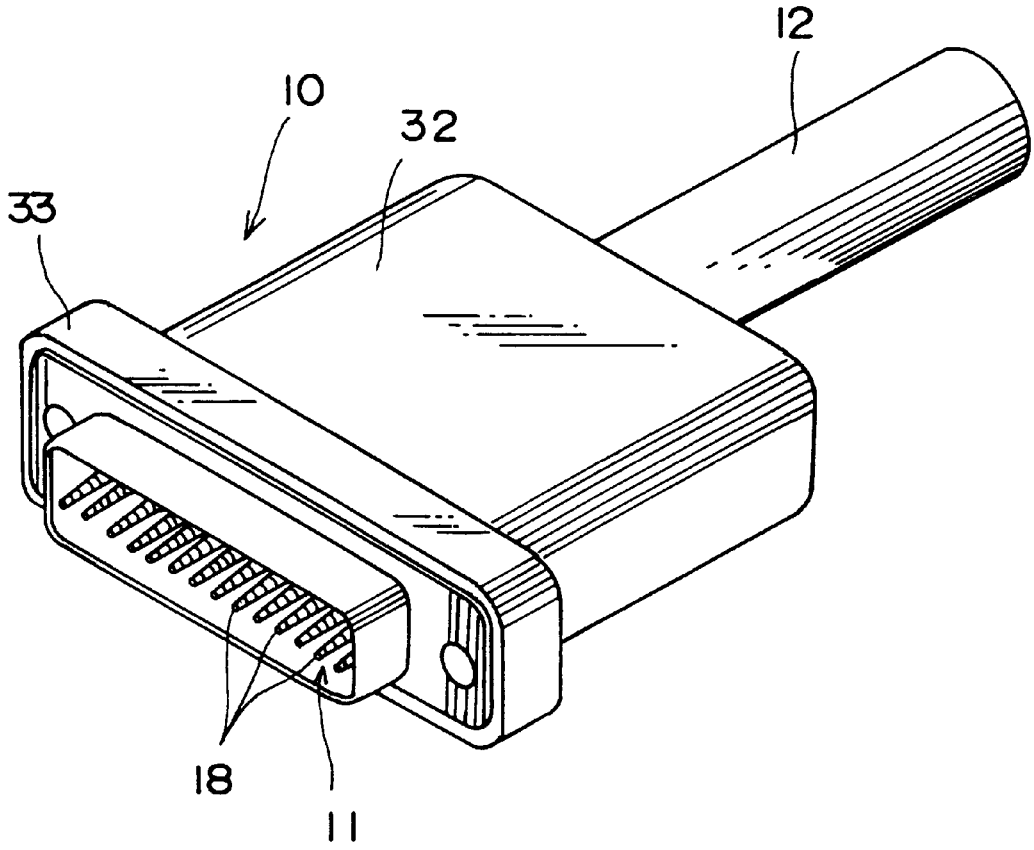
FIG. 1 is a perspective view of a shielded-cable connector according to an embodiment of the present invention.
Figure 2:
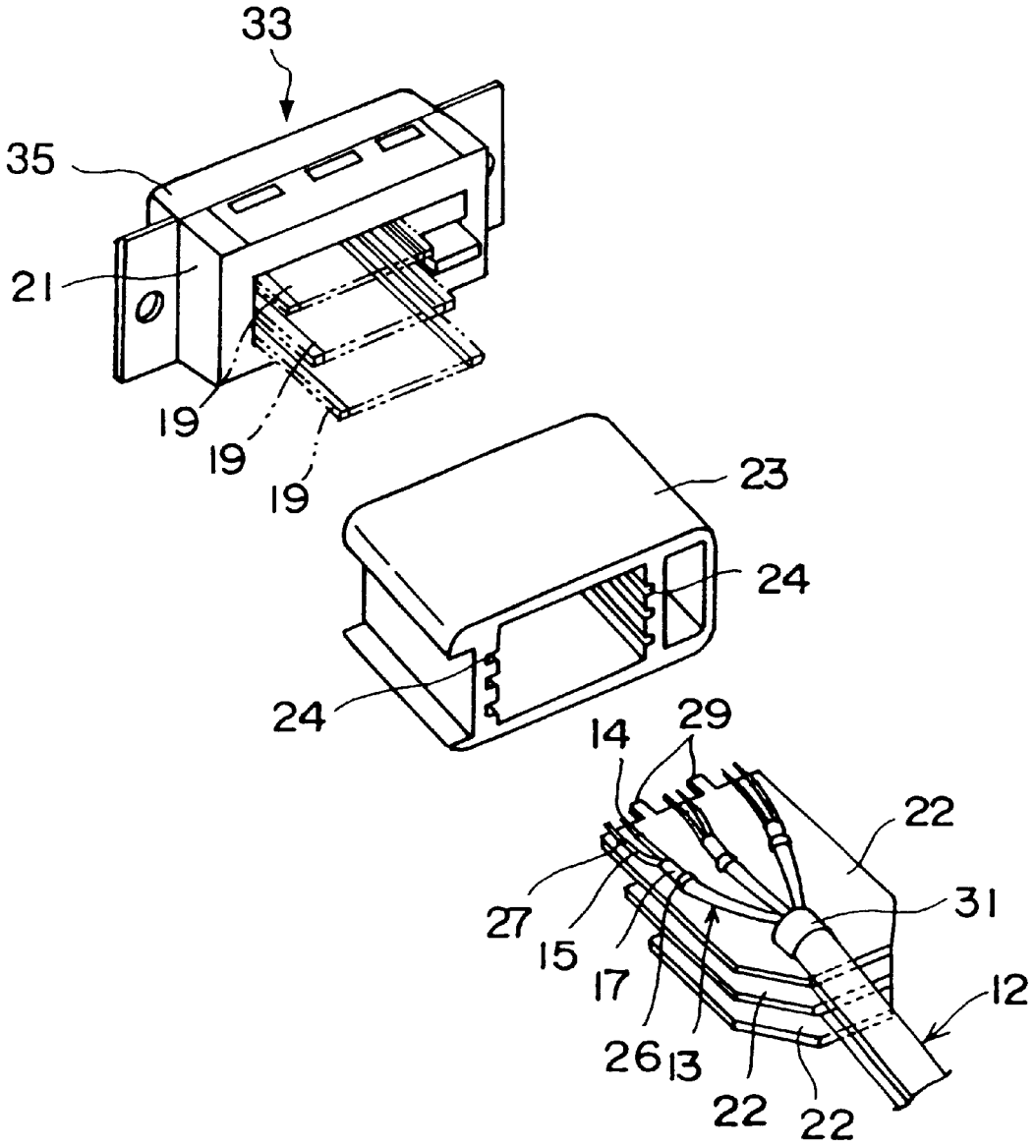
FIG. 2 is an exploded perspective view showing an internal structure of the shielded-cable connector illustrated in FIG. 1.
Figure 3:
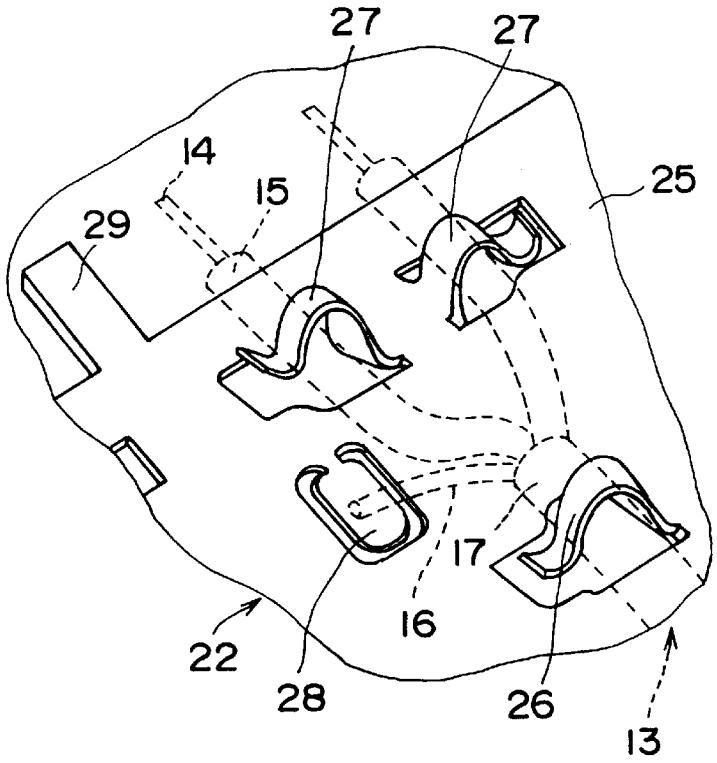
FIG. 3 is an enlarged perspective view of a characteristic part of a metal plate used in the shielded-cable connector illustrated in FIG. 1.

Referring to FIGS. 1 through 3, description will be made about a shielded-cable connector according to an embodiment of the present invention.

The shielded-cable connector is depicted by a reference numeral 10 and comprises a number of conductive contacts 11 which are arranged in a plurality of rows, for example, in three rows, parallel to one another in a vertical direction and located on the front side facing a mating connector (not shown). The connector 10 has a rear side from which a composite electric cable 12 is led out. The composite electric cable 12 comprises a combination of a plurality of shielded cables 13 covered by an insulating outer sheath. Each of the shielded cables 13 comprises a plurality of conductive core wires 14, a plurality of insulating inner sheaths 15 surrounding the core wires 14, respectively, a plurality of conductive shield wires 16 surrounding the insulating inner sheaths 15, respectively, and a plurality of insulating members 17 surrounding the shield wires 16, respectively. Each of the contacts 11 has a contacting portion 18 formed at one end thereof to be connected to the mating connector and a cable connecting portion 19 formed at the other end to be connected to the core wire 13 by soldering or the like.

Each of the conductive core wires 14 is referred to as a first conductive wire. Each of the insulating inner sheaths 15 is referred to as a first insulating member. Each of the conductive shield wires 16 is referred to as a second conductive wire. Each of the insulating members 17 is referred to as a second insulating member.

The connector 10 further comprises an insulator housing 21 fixedly holding the contacts 11, a plurality of, for example, three metal member or metal plates 22 connected to the composite electric cable 12 and arranged on the rear side of the insulator housing 21, and an insulating locator housing 23 facing a rear surface of the insulator housing 21 and positioning the metal plates 22. The cable connecting portions 19 of the contacts 11 in the different rows have different distances from the insulator housing 21, respectively. Specifically, the cable connecting portions 19 of the contacts 11 in the uppermost row are closest to the insulator housing 21 while the cable connecting portions 19 of the contacts 11 in the lowermost row are farthest from the insulator housing 21.

The metal plates 22 have some flexibility and are inserted into positioning grooves 24 of the locator housing 23 with a predetermined space kept from one another. The metal plates 22 are different in length from one another in an insertion direction so that soldering portions between the cable connecting portions 19 of the contacts 11 and the core wires 14 are shifted in position from row to row. This structure is preferable in view of the efficiency in soldering operation. Preferably, the metal plates 22 are subjected to plating.

Next, description will be made about the relationship between the metal plates 22 and the composite electric cable 12.

Each of the metal plates 22 comprises a plate portion 25, a first holding portion 26 connected to the plate portion 25, a positioning portion 27, a grounding pad 28, a terminal portion 29, and a second holding portion 31. The plate portion 25 is of a flat plate shape and receives the shielded cable 13 so as to face the insulating inner sheaths 15 in a radial direction of the shielded cable 13.

The first holding portion 26 is formed by cutting, bending, and shaping a part of the metal plate 22. The first holding portion 26 has flexibility and is adapted to clamp the shielded cable 13 between the first holding portion 26 and the plate portion 25 at a position around the insulating member 17.

The positioning portion 27 is formed by cutting, bending, and shaping a part of the metal plate 22. The positioning portion 27 has flexibility and clamps the core wire 14 between the positioning portion 27 and the plate portion 25 at a position around the insulating inner sheath 15.

The grounding pad 28 is formed by making a narrow cut in the metal plate 22 and clamps the shield wire 16 or the core wire 14 of the shielded cable 13 in cooperation with the plate portion 25. The terminal portion 29 serves as a ground terminal. The second holding portion 31 clamps the composite electric cable 12 at a position around the insulating outer sheath to fixedly hold the composite electric cable 12 on the metal plate 22. A combination of the first holding portion 26 and the second holding portion 31 forms a fixing arrangement for fixing the composite electric cable 12 to the metal plate 22.

The positioning portion 27 and the plate portion 25 clamp in cooperation with to each other to hold the core wire 14 at the position around the insulating inner sheath 15. As a result, the core wire 14 is fixed at a position apart from the plate portion 25 by a distance corresponding to the thickness of the insulating inner sheath 15. Thus, the plate portion 25 of the metal plate 22 faces the side surface of the shielded cable 12 with a predetermined positional relationship kept between the plate portion 25 and the core wire 14. Therefore, transmission characteristics within the connector 10 can be prevented from being deteriorated. The predetermined positional relationship between the plate portion 25 and the core wire 14 may be provided by holding the insulating inner sheath 15 of the shielded cable 13 by the positioning portion 27 and the plate portion 25. That is the insulating inner sheath 15 is spaced by a certain distance from the plate portion 25.

Practically, the shielded-cable connector is assembled as follows. At first, the metal plates 22 are connected to the composite electric cable 12. Thereafter, the metal plates 22 are inserted into the positioning grooves 24 of the locator housing 23. In this state, the core wires 14 are connected by soldering to the cable connecting portions 19 of the contacts 11. Thereafter, as shown in FIG. 1, the locator housing 23 and the insulator housing 21 are covered from the outside with a metal hood 32 for EMI (electromagnetic interference) shielding. The hood 32 is brought into tight contact with a shell 35 of a plug 33 and sealed by soldering throughout an entire circumference.

Figure 4:
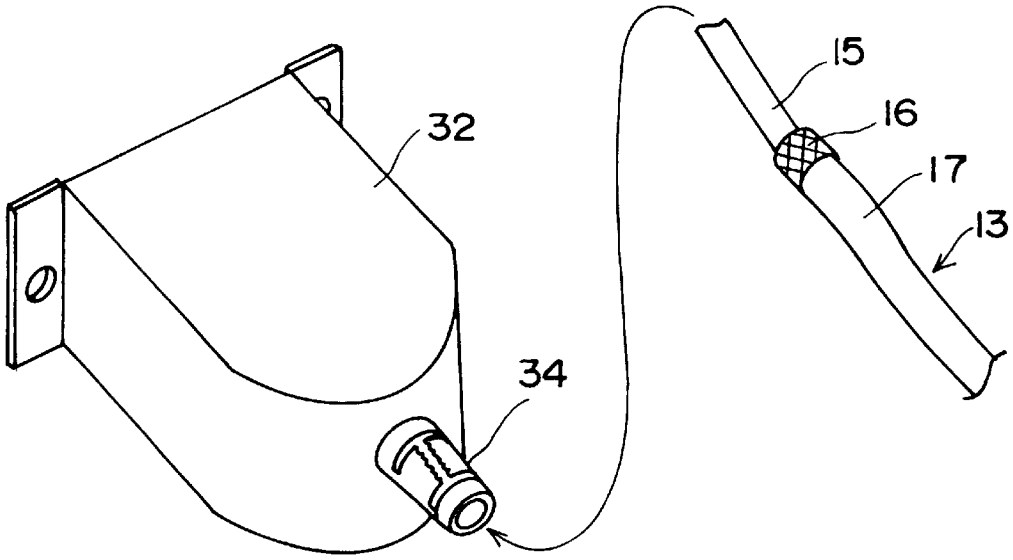
FIG. 4 is a perspective view for describing a modification of the shielded-cable connector illustrated in FIG. 1.

Referring to FIG. 4, the hood 32 may be provided with a caulking or staking portion 34 made of metal. The shield wire 16 of the shielded cable 13 is caulked by the caulking portion 34 to obtain electrical connection. It will readily be understood that the shield wire 16 may be connected to the hood 32 by soldering. Moreover, use may be made of other various components for connection.

While the present invention has thus far been described in connection with a few embodiments thereof, it will readily be possible for those skilled in the art to put this invention into practice in various other manners. For example, the number of the shielded cables or the core wires can be varied as desired. The number of the metal plates is equal to three in the foregoing embodiment but may be one, two, or four or more.

What is claimed is:

1. A shielded-cable connector for use in connecting a mating connector with a shielded cable which comprises a first conductive wire, a first insulating member surrounding said first conductive wire, a second insulating member surrounding said first insulating member, a second conductive wire extending between said first and said second insulating member, said shielded-cable connector comprising:

an insulator housing;

a conductive contact held by said insulator housing, said conductive contact comprising a contacting portion for coming in contact with said mating connector and a cable connecting portion to be connected to said first conductive wire; and a metal member held by said insulator for connecting said second conductive wire to ground, said metal member comprising a plate portion for facing said first insulating member in a radial direction of said shielded cable and positioning portion connected to said plate portion for directly holding said first insulating member in cooperation with said plate portion to provide a predetermined positional relationship between said first conductive wire and said plate portion.

2. The shielded-cable connector according to claim 1, wherein said metal member further comprises a fixing portion connected to said plate portion for fixing said shielded cable to said plate portion.

3. The shielded-cable connector according to claim 1, wherein said metal member further comprises a terminal portion for connection to the ground.

4. A shielded-cable connector for use in connecting a mating connector with a shielded cable which comprises a first conductive wire, a first insulating member surrounding said first conductive wire, a second insulating member surrounding said first insulating member, and a second conductive wire extending between said first and said second insulating member, said shielded-cable connector comprising:

an insulator housing;

a conductive contact held by said insulator housing, said conductive contact comprising a contacting portion for coming in contact with said mating connector and a cable connecting portion to be connected to said first conductive wire;

a metal member held by said insulator housing for connecting said second conductive wire to ground, said metal member comprising a plate portion for facing said first insulating member in a radial direction of said shielded cable and a positioning portion connected to said plate portion for directly holding said first insulating member in cooperation with said plate portion to provide a predetermined positional relationship between said first conductive wire and said plate portion; and a hood covering said insulator housing and said metal member.

5. The shielded-cable connector according to claim 4, wherein said metal member further comprises a fixing portion connected to said plate portion for fixing said shielded cable to said plate portion.

6. The shielded-cable connector according to claim 4, wherein said metal member further comprises a terminal portion for connection to the ground.

7. The shielded-cable connector according to claim 4, wherein said hood has a cable holding portion for holding said shielded cable to be connected to said second conductive wire.

8. A shielded-cable connector for use in connecting a mating connector with a plurality of shielded cables each of which comprises a first conductive wire, a first insulating member surrounding said first conductive wire, a second insulating member surrounding said first insulating member, and a second conductive wire extending between said first and said second insulating members, said shielded-cable connector comprising:

an insulator housing;

a plurality of conductive contacts held by said insulator housing, each of said conductive contacts comprising a contacting portion for coming in contact with said mating connector and a cable connecting portion to be connected to said first conductive wire;

a plurality of metal members held by said insulator housing for connecting said second conductive wire to ground, each of said metal member comprising a plate portion for facing said first insulating member in a radial direction of each of said shielded cables and a positioning portion connected to said plate portion for directly holding said first insulating member in cooperation with said plate portion to provide a predetermined positional relationship between said first conductive wire and said plate portion; and a locator housing coupled to said insulator housing and holding said metal members to have a predetermined interval between adjacent ones of said metal members.

9. The shielded-cable connector according to claim 8, wherein each of said metal members further comprises a fixing portion connected to said plate portion for fixing said shielded cable to said plate portion.

10. The shielded-cable connector according to claim 8, wherein each of said metal members further comprises a terminal portion for connection to the ground.

11. The shielded-cable connector according to claim 8, further comprising a hood covering said insulator and said metal members.

12. The shielded-cable connector according to claim 11, wherein said hood has a cable holding portion for holding said shielded cable to be connected to said second conductive wire.

* * * * *